US005409148A

United States Patent [19]

Stern et al.

[11] Patent Number: 5,409,148

[45] Date of Patent: * Apr. 25, 1995

[54] SPRAY TEXTURING APPARATUS AND METHOD WITH DISPENSING TUBE

[76] Inventors: Donald J. Stern, 2078 Dellesta Dr., Bellingham, Wash. 98226; James A. Tryon, 420 Smith St., Seattle, Wash. 98109

[ * ] Notice: The portion of the term of this patent subsequent to May 10, 2011 has been disclaimed.

[21] Appl. No.: 238,471

[22] Filed: May 5, 1994

Related U.S. Application Data

[63] Continuation of Ser. No. 840,795, Feb. 24, 1992, Pat. No. 5,310,095.

[51] Int. Cl.[6] ..... B65D 83/14

[52] U.S. Cl. ..... 222/402.1; 239/391; 239/397

[58] Field of Search ..... 222/526, 527, 530, 538, 222/575, 402.1, 567, 402.24, 394; 239/1, 337, 390, 391, 397, 346, 345, 348

[56] References Cited

U.S. PATENT DOCUMENTS

| | | | |
|---|---|---|---|
| 931,757 | 8/1909 | Harmer | 239/391 |
| 2,908,446 | 10/1959 | Strouse | 222/394 |
| 3,191,809 | 6/1959 | Schultz et al. | 222/567 |
| 3,258,208 | 6/1966 | Greenbaum, II | 239/397 |
| 3,472,457 | 10/1969 | McAvoy | 239/337 |
| 3,703,994 | 11/1972 | Nigro | 239/397 |
| 4,991,750 | 2/1991 | Moral | 222/567 |
| 5,037,011 | 8/1991 | Woods | 239/346 |
| 5,310,095 | 5/1994 | Stern et al. | 222/402.1 |

*Primary Examiner*—Andres Kashnikow
*Assistant Examiner*—Philippe Derakshani

[57] ABSTRACT

A method for applying a spray texture material to a wall surface utilizing an aerosol container for the texture material, along with discharge tubes through which the material is dispensed. By using tubes of different cross-sectional area, the spray patterns of the material can be made with smaller and larger particle size within more precisely controlled limits.

53 Claims, 3 Drawing Sheets

SPRAY TEXTURING APPARATUS AND METHOD WITH DISPENSING TUBE

This is a continuation of application Ser. No. 07/840,795, filed on Feb. 24, 1992, now U.S. Pat. No. 5,310,095.

The present invention relates to the art of spray texturing, and more particularly to an apparatus and method by which spray texturing can be accomplished to provide spray patterns of varying texture (i.e. with either finer or more coarse particle size).

BACKGROUND OF THE INVENTION

When drywall panels are installed in a building, and the seams taped, prior to painting the wall surface, there is often applied a spray texture, which is followed by painting. The spray texture will provide a desirable background pattern, and also obscure some of the seams that might appear in the drywall surface.

There are in the prior art various spray texturing tools or devices which utilize pressurized air to spray the texture material onto the wall surface. Some of these use compressed air as the gaseous medium to spray the textured material, with the pressurized air being derived from a remote source that feeds the air through a hose to the tool. There are also tools which are totally handheld, with the pressurized air being produced by manually reciprocating the piston of an airpump that is built into the tool.

When an existing drywall surface is being repaired, quite often a small section of drywall will be removed and another piece of drywall put in its place. The seams of this piece of drywall must then be taped, and (if the surrounding surface is textured) then have a texture surface treatment that would make it match with the surrounding drywall surface. It is, of course, desirable to have the spray pattern on the patch match that of the surrounding surface.

Also, when a rather small "patch" of drywall is to be spray textured, there is the matter of convenience. One approach has been simply to provide the spray texture material in an aerosol can, and the textured material is dispensed directly from the can to be sprayed onto the drywall surface. However, one of the considerations is how this can be accomplished in a manner to provide proper matching of the texture with that which is on the surrounding drywall.

U.S. Pat No. 5,037,011 (Woods) discloses such an aerosol texture spraying device where the spray texture material is dispensed directly from the nozzle of the aerosol can. In a commercial embodiment of a device such as this, when there is higher pressure in the container, there is a relatively fine spray pattern. For a more coarse pattern (i.e. with larger particle sizes), the can is inverted and the nozzle depressed to dispense a certain amount of the propellant gas for a few seconds. Then the can is turned upright and the spray texture material dispensed at a lower pressure to provide the spray pattern with larger particle sizes.

SUMMARY OF THE INVENTION

The object of the present invention is to provide a method and apparatus by which a spray texture can be applied to a wall surface, such as a drywall surface, with the character of the spray pattern, in terms of particle size and consistency, being accomplished with greater precision and uniformity.

Further, it is an object to accomplish this in a manner that one section of a wall surface can be sprayed with a texture material that matches more closely a surrounding, existing textured surface. It is a further object to provide a method and apparatus which can be accomplished quite conveniently utilizing an aerosol container to discharge the spray texture material.

In the method of the present invention, there is provided an apparatus to discharge a spray texture material through a nozzle means having a nozzle discharge opening to dispense this material. There is further provided a first delivery tube means having a first discharge passageway of a first predetermined cross-sectional area. The material discharge apparatus is operated to cause the textured material to be discharged through the tube means.

Then a second discharge tube means is positioned to receive material from the discharge nozzle means, and this second tube means has a second discharge passageway with a second predetermined cross-sectional area different from the first cross-sectional area.

Thus, a finer spray pattern can be achieved by utilizing a tube means with a passageway having a lesser cross-sectional area, and a coarse pattern can be achieved by discharging said material through the tube means having a greater cross-sectional area.

Desirably, the cross-sectional area of the passageway means is equivalent to a cross-sectional circular area with a given diameter, with a given diameter being between one quarter of a tenth of an inch and one quarter of an inch. Desirably, this given diameter is between about one half of a tenth of an inch and one and one half of an inch.

The tube means desirably has a discharge passageway length of at least a half an inch, preferably at least one inch, more preferably at least approximately two inches, with a quite satisfactory length being four inches.

Also, in a preferred form, the nozzle means has a nozzle opening of a predetermined nozzle opening cross-sectional area, and at least one of the tube means has a passageway cross-sectional area greater than the nozzle opening discharge area, and a second one of said tube means having a passageway with a cross-sectional area less than said nozzle cross-sectional area. Also, in a preferred form there is provided a third tube means with a cross-sectional area substantially the same as that of the nozzle opening, within twenty five percent.

Desirably, the discharge apparatus is provided in the form of an aerosol apparatus, comprising an aerosol container to which the nozzle means is mounted, and the discharge tube means is mounted to said nozzle means.

Other features will become apparent from the following detailed description.

DESCRIPTION OF THE PREFERRED EMBODIMENT

Figure 1:
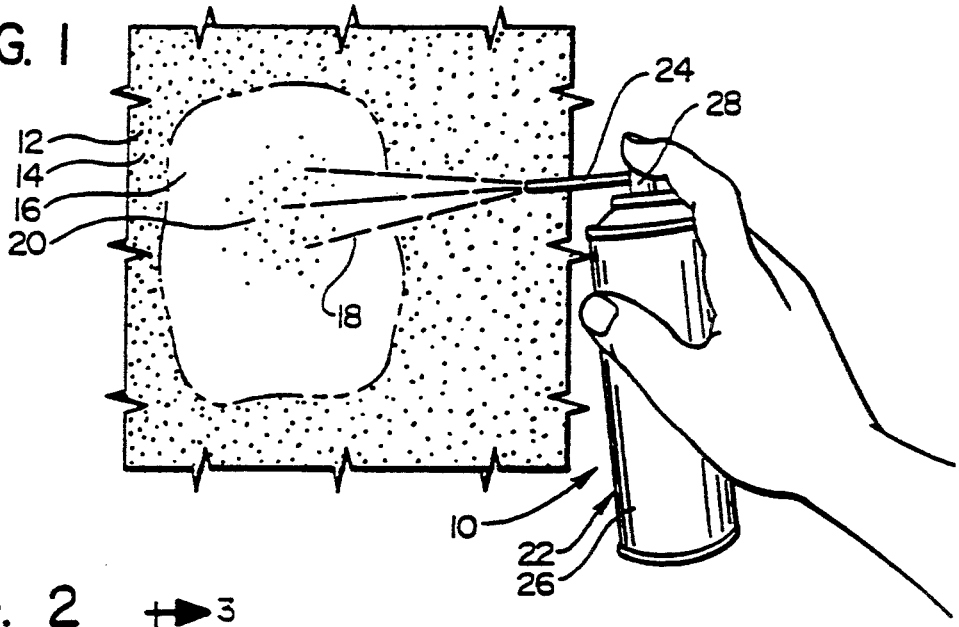
FIG. 1 is an isometric view illustrating a preferred embodiment of the present invention applying a spray texture material to a patch on a drywall surface.

In FIG. 1, there is shown the apparatus 10 of the present invention being used in spraying the texture material onto a section of wallboard 12 having a previously sprayed surface portion 14 surrounding an unsprayed portion 16 which could be, for example, a more recently applied piece of wallboard that serves as a "patch". The spray itself is indicated at 18, and the spray material deposited on the wall portion 16 as a sprayed texture is indicated at 20.

Figure 2:
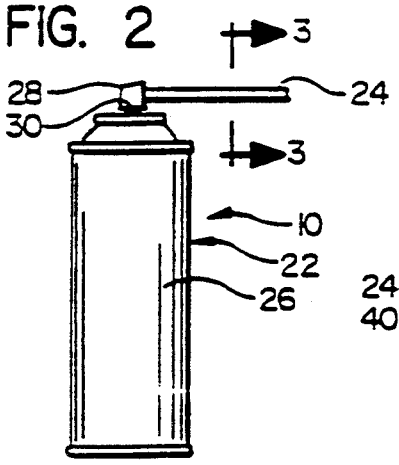
FIG. 2 is a side elevational view of the apparatus of the present invention.

With reference to FIG. 2, the present invention is shown being incorporated with an aerosol spray containing device 22, the basic design of which is or may be conventional in the prior art. Used in combination with this container 22 is a dispensing tube 24 which is a critical feature of the present invention. More particularly, it has been found by utilizing this dispensing tube 24 in particular arrangements to discharge the spray texture material, more precise control of the spray texture pattern can be achieved. Further, there are other advantages, in that not only is a more controllable spray pattern achieved, but this consistency of the spray pattern can be accomplished for a relatively long period of use. In other words, even after a substantial amount of the spray texture material has been already discharged from the aerosol dispensing container 22, the spray pattern remains rather consistent. The manner in which this is achieved will be described more fully later herein.

It is recognized that in the prior art tubular members have been used in combination with an aerosol spray can to deliver a material, such as a lubricant. To the best knowledge of the applicants, however, this use has been primarily to enable the aerosol container to deliver the fluid, such as a lubricating oil, to a somewhat inaccessible location, and not to achieve the ends of the present invention.

To return to our description of the aerosol dispensing device 22, as indicated above, the basic design is or may be conventional. As shown herein, the device 22 comprises a cylindrical container 26 and a dispensing nozzle member 28 positioned at the top of the container 26. As is common in the prior art, this dispensing member 28 in its upright position blocks flow of material from the container 26. This dispensing member 28 is attached to a downwardly extending stem 30, and when the member 28 is depressed, a valve opens within the container 22 so that the material in the container 22 flows upwardly through the stem 30 and laterally out a nozzle formed in the dispensing nozzle member 28. Since the manner in which this is achieved is well known in the prior art, this will not be described in detail herein, Reference is now made to FIGS. 16 through 18, and it can be seen that the stem 30 provides a passageway 32 through which the spray texture material flows upwardly, and then is directed laterally to be discharged through a lateral nozzle opening 34. The passageway 32 and nozzle 34 can have their dimensions and configuration optimized for proper performance, and the manner in which this is done is also known in the prior art.

In the present invention, the nozzle member 28 is provided with a counterbore 36 having a moderately enlarged diameter, relative to the diameter of the nozzle opening 34. Both the nozzle opening 34 and the counterbore 36 have a cylindrical configuration. The dispensing tube 24 has an outside diameter so that its end portion is able to fit snuggly within the counterbore 36, with the end surface of the tube 34 bearing against the forwardly facing annular shoulder 38 defined by the counterbore 36 with the nozzle opening 34.

Figure 3:
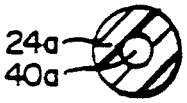
FIG. 3 is a sectional view taken along 3—3 of FIG. 2, this being done to illustrate the inside diameter of the discharge tube which is made relatively small to provide a spray texture pattern of a more fine particle size.
Figure 7:
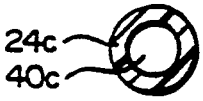
FIGS. 7 and 8 are similar to FIGS. 3 and 4, respectively, with FIG. 7 showing the cross section of a discharge tube of yet larger inside diameter for the flow passageway, and FIG. 8 showing the spray pattern with a yet larger particle size.

In the preferred embodiment of the present invention, a plurality of dispensing tubes 24 are provided, and in the present embodiment, there are three such tubes, 24*a*, 24*b* and 24*c*. It can be seen from examining FIGS. 3, 5 and 7 (and also FIGS. 16, 17 and 18) that the outside diameter of all three tubes 24*a*, 24*b*, and 24*c* have the same outside diameter, but different inside diameters for the discharge passageway 40.

Figure 4:
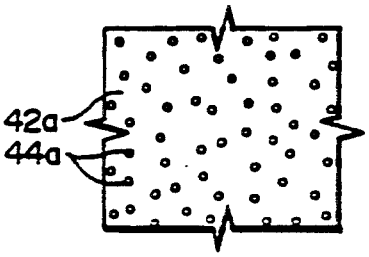
FIG. 4 illustrates somewhat schematically a spray texture pattern in a wall surface which has relative fine particle size.

It has been found that by selecting different diameters for the discharge passageway 40, the spray texture pattern can be controlled more accurately. With the smaller diameter 40*a* of the discharge tube 24*a*, shown in FIG. 3, a relatively fine spray texture pattern can be achieved, as shown in FIG. 4, where the particles of spray texture material are of a small particle size, as shown in the wall section 42*a*.

Figure 5:
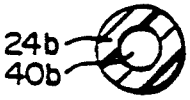
FIGS. 5 and 6 are views similar to FIGS. 3 and 4, with FIG. 5 showing a discharge passageway of a larger inside diameter, and FIG. 6 showing the spray pattern with a larger particle size.
Figure 6:
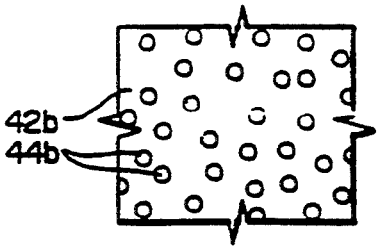
Figure 8:
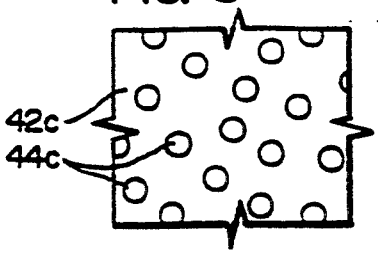

In FIG. 5, the interior discharge passageway 40*b* is of a more intermediate size, and this results in a discharge pattern which has a somewhat larger particle size, as shown in the wall section 42*b*. Then, with the yet larger diameter discharge opening 40*c*, as can be seen in FIG. 8, the wall section 42*c* having a spray texture pattern with a yet larger particle size. The particles of the board section 42*a*, 42*b*, and 42*c* are designated as, respectively, 44*a*, 44*b* and 44*c*.

With regard to the spray texture material itself, if has been found that quite desirable results can be achieved where the basic composition of the spray texture material comprises a resin or resins, particulate filler material and a propellant. Also, there is a solvent, and desirably dryers to accelerate the drying reaction of the resin with oxygen.

More specifically, the resin or resins desirably comprise alkyd resins, and more specifically those which are generally called bodying alkyds or puffing alkyds. Such alkyds are sometimes used for what are called "architectural coatings". The resins are made somewhat more gelatinous than would be used in other applications, this depending upon the spray characteristics that are desired. If the alkyd resins are made more gelatinous or viscous, a coarser spray pattern would be expected for a particular set of conditions.

The particulate filler material desirably has various particle sizes, and this can be a filler material or materials which are well known in the prior art, such as calcium carbonate, silica, talc, wollastonite, various types of pigments, etc.

The propellant is desirably a liquified hydrocarbon gas, with this liquified gas being dispersed throughout the texture material composition, such as being dissolved therein or otherwise dispersed therein. The propellant is characterized that under the higher pressure within the container the propellant remains dispersed or dissolved as a liquid throughout the spray texture material, and upon release of pressure, the propellant begins going back to its gaseous form to act as a propellant and push the material up the stem passageway 32 and out the nozzle opening 34.

The solvent is desirably aromatic and/or aliphatic hydrocarbons, ketones, etc.

The dryer or dryers would normally be metallic dryer, such as various metal salts. These are already well known in the art, so these will not be described in detail herein.

It has been found that this type of texture material can be sprayed by using the present invention to provide a reasonably consistent spray texture for a given configuration of the tube 24. Also, it has been found that this consistency of spray pattern can be accomplished throughout the discharge of the great majority of the spray texture material within the container 26.

Figure 16:
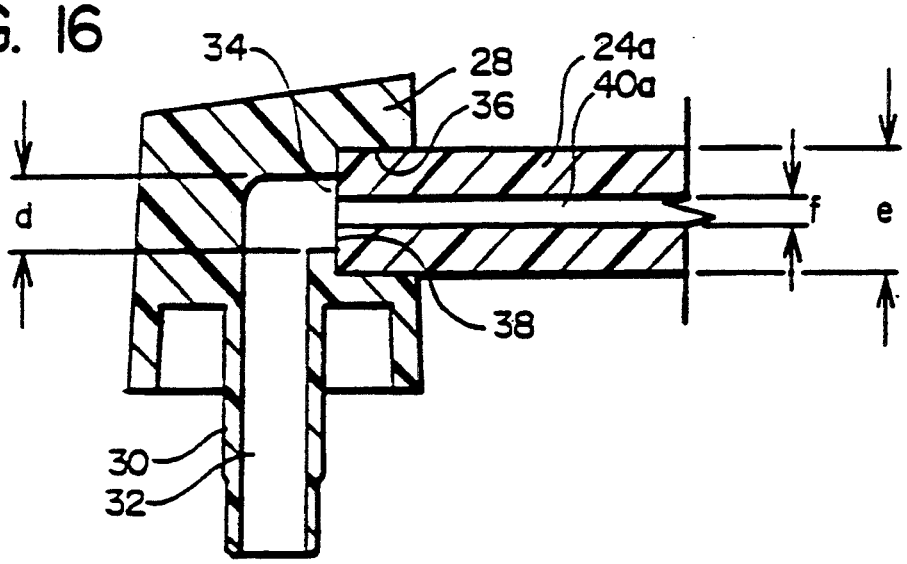
FIG. 16 is a cross sectional view taken through the dispensing head of the aerosol container, with this plane being coincident with the lengthwise axis of the dispensing tube and the vertical axis of the dispensing head, showing only the discharge orifice portion of the dispensing head, and further with the smaller inside diameter tube shown in FIG. 3.
Figure 17:
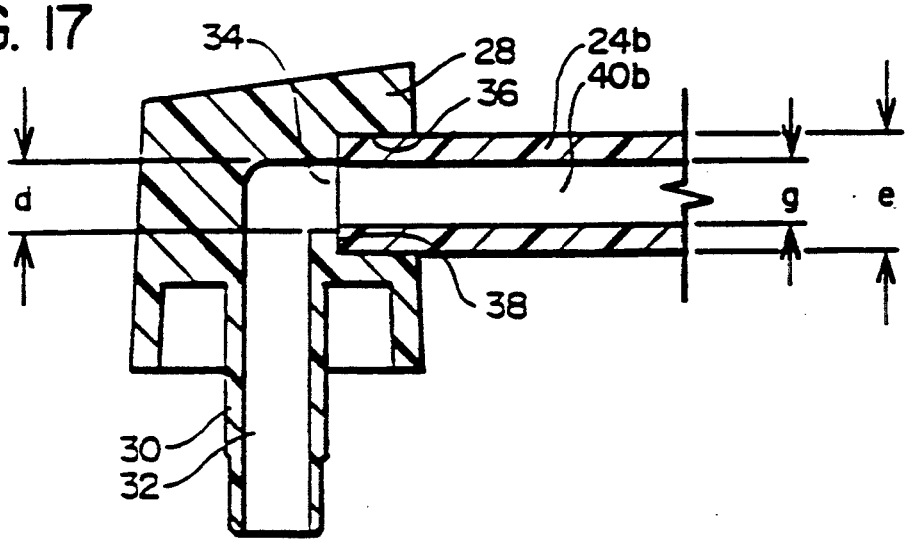
FIG. 17 is a view similar to FIG. 16, but showing the dispensing head having the medium inside diameter tube of FIG. 5 positioned therein.
Figure 18:
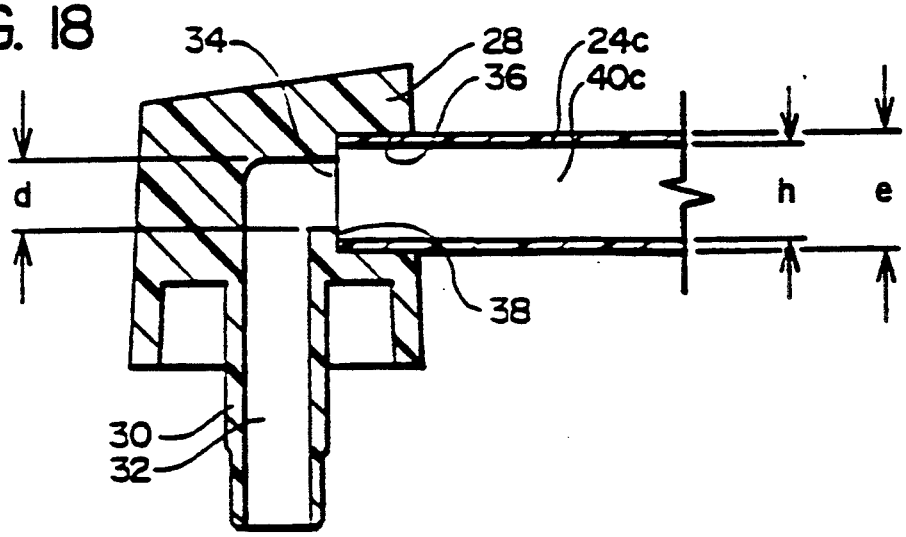
FIG. 18 is a view similar to FIGS. 16 and 17, but showing the dispensing tube of FIG. 7 having the largest inside diameter, as shown in FIG. 7.

With regard to the particular dimensions utilized in this preferred embodiment of the present invention, reference is made to FIGS. 16 through 18. The diameter "d" of the nozzle orifice 34 is in this particular embodiment 0.102 inch, and the diameter of the counterbore (indicated at "e") is 0.172 inch; the diameter "f" of the passageway 40*a* (i.e. the smallest diameter passageway) is 0.050 inch; the diameter "g" of the intermediate sized passageway 40*b* (see FIG. 17) is 0.095 inch; and the diameter "h" of the largest tube passageway 40*c* is 0.145 inch.

Thus, it can be seen in the arrangements of FIGS. 16 through 18 that in FIG. 16, there is a substantial reduction in the cross-sectional area of the passageway 40*a*, with this having about one half the diameter of the nozzle opening 34, so that the passageway area 40*a* is about one quarter of the nozzle opening 34.

In the intermediate size of FIG. 17, the diameter and cross-sectional area of the passageway 40*b* (indicated at "g") is nearly the same as that of the nozzle 34.

In FIG. 18, the diameter of the passageway 40*c* (indicated at "h") is slightly less than one and one half of the nozzle opening 34, and the cross sectional area is about twice as large.

Figure 9:
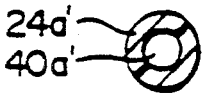
FIGS. 9, 10 and 11 correspond to, respectively, FIGS. 3, 5 and 7 and show a different arrangement of discharge tubes where the outside diameter varies.
Figure 10:
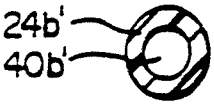
Figure 11:
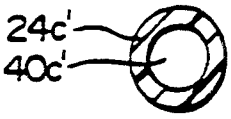

FIGS. 9, 10 and 11 show an alternative form of the tubes 24*a–c*, and these tubes in FIG. 9 through 11 (designated 24*a'*, 24*b* 'and 24*c'*) have the same internal passageway cross-sectional area as the passageways 24*a*, 24*b* and 24*c*, respectively, but the outside diameter of these are made smaller, relative to the passageway size. If there is such varying outside diameters, then a plurality of mounting collars could be used, with these having consistent outside diameters, but varying inside diameters to fit around at least the smaller tubes of FIGS. 9 and 10.

Figure 12:
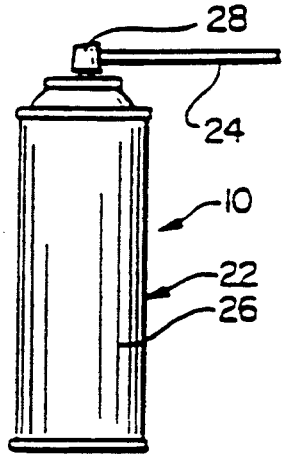
FIGS. 12, 13 and 14 illustrate the apparatus having tubes 24 of different lengths.
Figure 13:
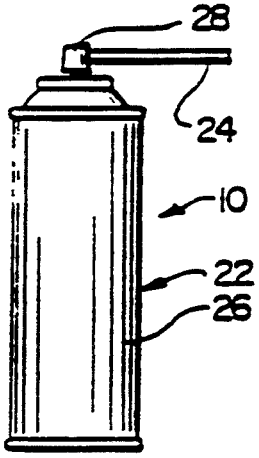
Figure 14:
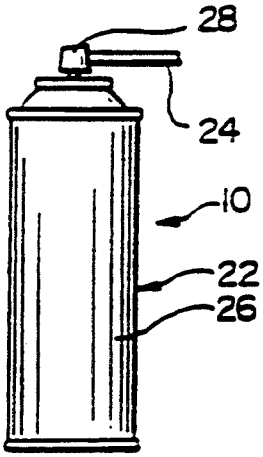

FIGS. 12 through 14 are simply shown to illustrate that the length of the tube 24 can be varied. It has been found that a rather desirable length of the tube 24 is approximately four inches. While a longer tube length could be used, in general there is no particular advantage in doing so since the proper consistency can be obtained with a tube of about four inches. Also, experiments have indicated that the length of the tube 24 can be reduced lower than four inches, possibly to two inches and even as low as one inch) without causing any substantial deterioration of the consistency and quality of the formation of the spray pattern. However, it has been found that somewhat more consistent results can be obtained if the length of the tube 24 is greater than one inch and at least as great or greater than two inches.

A tube length as short as one half inch has been tried, and this is able to provide a substantial improvement of performance over what would have been obtained simply by discharging the spray texture directly from the nozzle opening 34, without any tube, relative to controlling spray pattern. The shorter tube 24 (as small as one half inch) provides a significant benefit, but not the full benefit of the longer tube 24. The very short tube (e.g. one half inch) has a lesser quality of performance when used with the larger diameter passageway 40 than with the smaller passageway.

Figure 15:
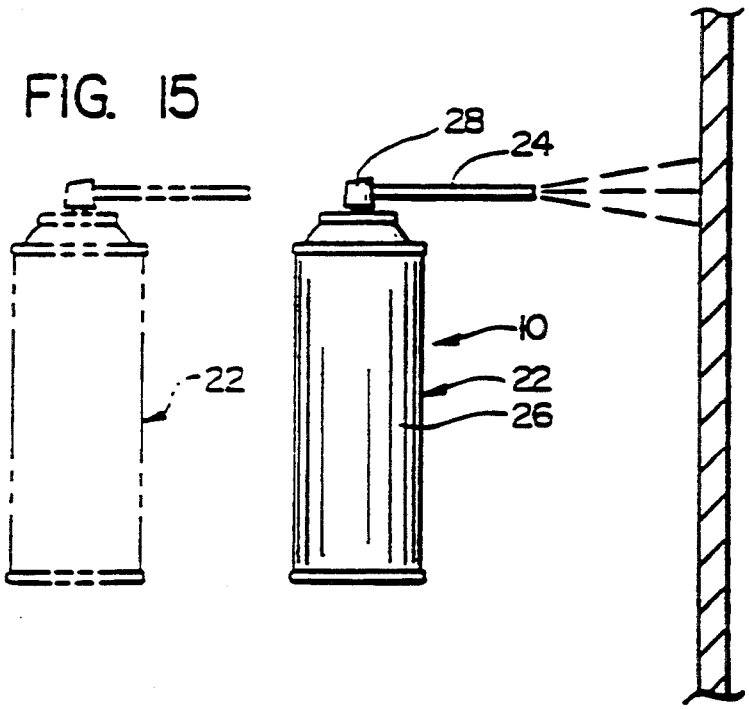
FIG. 15 is a side elevational view of the apparatus as shown being positioned closer to or further from a wall surface.

FIG. 15 illustrates that the texture pattern can also be controlled to some extent by moving the apparatus 10 closer to or farther away from the wall surface. If the apparatus 10 is moved rather close to the wall surface, the density of the applied material is increased for a given time of exposure. It has been found that in general satisfactory results can be obtained if the apparatus 10 is held approximately three feet from the wall surface. However, this will depend upon a number of factors, such as the pressure provided by the propellant, the character of the spray texture material, and other factors.

To describe now the operation of the present invention, an aerosol dispensing device 22 is provided as described previously herein with the spray texture material contained within the can 26 at a desired pressure. As is common with aerosol cans, it is desirable to shake the device 22 for a few seconds prior to depressing the nozzle control member 28.

If a relatively fine texture is desired, then a smaller diameter tube such as at 24*a* is used. For spray texture patterns having larger particle size, the larger diameter tube is used.

The person directs the nozzle opening 34 and the tube 24 toward the wall surface to be sprayed and depresses the nozzle member 28. As the spray texture material is discharged, the container 26 is moved back and forth and is tilted to different angles to spray the desired area.

As indicated earlier, it has been found that not only can a "fineness" or "coarseness" (i.e. smaller particle size or larger particle size, respectively) be controlled with reasonable precision by the present invention, but this consistency of the spraying pattern can be maintained throughout the discharge of the great majority of the spray material within the container 26. While these phenomena are not totally understood, it is believed that the following can be reasonably hypothesized to provide at least a partial explanation.

First, the separation of the texture material into particles of smaller or larger size is due in part to the character of the material itself, and also due in part to the way the forces are exerted on the material to tend to break it up into particles. More particularly, it can be hypothesized that if there is a greater shear force tending to separate the particles, it would be expected that there would be a finer pattern.

It is also recognized that when a fluid is moving through a conduit or tube, there is commonly what is called a velocity gradient along a transverse cross section of the flow of material. More precisely, the material immediately adjacent to the wall surface may have a very low velocity or practically no velocity. The adjacent material just a small distance away from the wall will have a somewhat greater velocity, but will still be retarded significantly due to the shear force provided by the material that is closer to the wall surface. As the cross section of the liquid material is analyzed closer toward the center, the shear force becomes less and the velocity becomes more uniform.

With the foregoing in mind, it also has to be recognized that if the diameter of the tube or conduit is reduced by one half, the cross-sectional area is reduced by one quarter. Thus, for the smaller tube (i.e. one half diameter) the surface area that provides a retarding force is doubled relative to the volume of flow at the same velocity). This would indicate that for a given cross-sectional segment of the fluid material being discharged, there is relatively greater shear force exerted for the smaller inside diameter tube. This would lead to the conclusion that for the discharge of a given amount of fluid at a certain velocity and at the same pressure, there would be a smaller particle size than if a tube of greater inside diameter were used.

Another phenomenon to be considered is with regard to the pressure which is forcing the textured material out of the tube 24. It can be surmised that if the pressure is greater, the velocity of the material traveling through the tube 24 would be greater, so that the shear forces exerted on the texture material would be greater so that smaller particle sizes would result.

It can be seen in FIG. 16 that the relatively small diameter passageway 40*a* serves as a restriction for the material flowing out the nozzle 34. This would tend to cause the velocity of the material flowing up the stem passageway 32 and out the nozzle opening 34 to decrease to some extent, but to have a relatively higher velocity out the passageway 40*a*. Further, it can be expected that the pressure of the propelling gas in the passageway 40*a* would be somewhat higher than if a larger diameter passageway such as 40*b* or 40*c* were utilized. Experimental results using different size tubes seem to verify this conclusion.

In FIG. 17, the diameter and cross-sectional area of the passageway 40*b* is nearly the same as that of the nozzle opening 34. Therefore it can be surmised that the velocity and pressure in the passageway 40*b* would be somewhat less than in the passageway 40*a*, this resulting in a somewhat larger particle size, and also a somewhat lower discharge velocity. Experimental results have verified this also.

Finally, with reference to FIG. 18, when the passageway diameter is larger than that of the nozzle opening 34 (as it is with the passageway 40*c*), it can be expected that the fluid discharged from the nozzle 34 would have a lower velocity and that there would be a lower propelling force provided by the propellant. Experimental results have indicated that this results in the coarser particle size.

However, it has to be recognized that while the above hypothesis can be proposed with reasonable justification, there are likely other phenomena involved which the applicants are either not aware of or have not fully evaluated. For example, with the propellant being disbursed in (and presumably dissolved in) the texture composition, it can be surmised that this propellant continues to go out of solution or dispersion into its gaseous form and expand to provide the propellant force, and this continues as the quantity of texture material continues to be reduced. This may also have a desirable effect on the formation of the particles and of the particle size, relative to consistency.

Nevertheless, regardless of the accuracy or correctness of the above explanations, it has been found that with the present invention, the spray pattern (and more particularly the particle size of the spray pattern) can be achieved with greater consistency and within relatively greater limits of particle size, than the prior art devices known to the applicants. Further, the consistency of the spray pattern can be maintained for the discharge of a large proportion of spray texture material from the apparatus 10.

It is to be recognized, of course, that various relative dimensions could be changed without departing from the basic teachings of the present invention. For example, it has been found that with spray texture material of a character which are acceptable in present day use, that a range of tube inside diameters of approximately one half of a tenth of an inch to one and one half tenth of an inch would give a reasonable range of texture spray patterns. However, it can be surmised that tube diameters outside of this range (e.g. one quarter of a tenth of an inch to possibly as high as one quarter of an inch would also provide acceptable texture spray patterns, depending upon a variety of circumstances, such as the viscosity and other characteristics of the spray texture material itself, the discharge pressure, the volumetric rate at which the spray texture material is delivered to the tube 24, and other factors.

It is to be recognized that various modifications can be made without departing from the basic teaching of the present invention.

What is claimed

1. A method of applying a hardenable liquid texture material onto a surface area to form a textured surface, said method comprising:

a. providing a texture material dispensing apparatus which has a discharge nozzle means and which is adapted to discharge said liquid material under pressure from said nozzle means;

b. providing a dispensing tube means, defining an elongate dispensing passageway having an inlet and an outlet, and locating the inlet of said dispensing tube means adjacent to said discharge nozzle means so that the liquid texture material from the discharge nozzle means flows into the inlet of said tube means and through said dispensing passageway;

c. positioning the apparatus with said dispensing tube means spaced from said surface area so that the outlet of the dispensing tube means is directed toward said surface area and spaced therefrom;

d. causing said liquid texture material to be delivered by said apparatus under pressure from said nozzle means and into said dispensing tube passageway to be discharged from the outlet of the tube means as a spray that is deposited on said surface area, with said texture material on said surface area hardening to form said textured surface.

2. The method as recited in claim 1, wherein said apparatus comprises an aerosol dispensing apparatus having a material containing portion containing said texture material and discharge nozzle means.

3. The method as recited in claim 2, wherein said texture material comprises a liquid with a particulate filler material therein, and there is within said material containing section a propellant to cause said texture material to be dispensed under pressure.

4. The method as recited in claim 3, wherein said propellant is a hydrocarbon gas.

5. The method as recited in claim 4, wherein said hydrocarbon gas is, when in said containing portion, liquefied and dispensed in said texture material.

6. The method as recited in claim 2, wherein said liquid texture material comprises a solvent, a particulate filler material and a propellant.

7. The method as recited in claim 6, wherein said liquid texture material further comprises a resin component.

8. The method as recited in claim 7, wherein said propellant is a hydrocarbon gas disbursed in said texture material in a liquefied form.

9. The method as recited in claim 2, wherein said propellant is a hydrocarbon gas disbursed in said texture material in a liquefied form.

10. The method as recited in claim 2, said dispensing tube means is detachably mounted to said discharging nozzle means.

11. The method as recited in claim 10, wherein said containing portion has a lower end and an upper end, and said nozzle means is positioned at the upper end of the containing portion, said nozzle means having a laterally extending nozzle opening, said dispensing nozzle means being arranged to be manually operable to cause the texture material to be discharged, said tube means being mounted to said nozzle means in a manner to be extending laterally therefrom.

12. The method as recited in claim 2, wherein said passageway has a cross-sectional area equivalent to a cross-sectional circular area of a given diameter with said given diameter being at least about one quarter of a tenth of an inch.

13. The method as recited in claim 12, wherein said given diameter is no greater than one quarter of an inch.

14. The method as recited in claim 12, wherein said given diameter is at least as great as about one half of a tenth of an inch.

15. The method as recited in claim 14, wherein said given diameter is no greater than about one and one half tenth of an inch.

16. The method as recited in claim 2, wherein said tube means has a discharge passageway length of at least one half an inch.

17. The method as recited in claim 16, wherein said passageway length is at least approximately one inch.

18. The method as recited in claim 16, wherein said passageway length is at least approximately two inches.

19. The method as recited in claim 16, wherein said passageway length is at least approximately four inches.

20. The method as recited in claim 1, wherein said texture material comprises a liquid with a particulate filler material therein.

21. The method as recited in claim 1, wherein said liquid texture material comprises a solvent and a particulate filler material.

22. The method as recited in claim 21, wherein said liquid texture material further comprises a resin component.

23. The method as recited in claim 1, said dispensing tube means is detachably mounted to said discharging nozzle means.

24. The method as recited in claim 1, wherein said passageway has a cross-sectional area equivalent to a cross-sectional circular area of a given diameter, with said given diameter being at least about one quarter of a tenth of an inch.

25. The method as recited in claim 24, wherein said given diameter is no greater than one quarter of an inch.

26. The method as recited in claim 24, wherein said given diameter is at least as great as about one half of a tenth of an inch.

27. The method as recited in claim 26, wherein said given diameter is no greater than about one and one half tenth of an inch.

28. The method as recited in claim 1, wherein said tube means has a discharge passageway length of at least one half an inch.

29. The method as recited in claim 28, wherein said passageway length is at least approximately one inch.

30. The method as recited in claim 28, wherein said passageway length is at least approximately two inches.

31. The method as recited in claim 28, wherein said passageway length is at least approximately four inches.

32. The method as recited in claim 2, wherein said passageway has a cross-sectional area equivalent to a cross-sectional circular area of a given diameter, with said given diameter being at least about one quarter of a tenth of an inch, and no greater than one quarter of an inch.

33. The method as recited in claim 32, wherein said given diameter is at least as great as about one half of a tenth of an inch, and no greater than about one and one half tenth of an inch.

34. The method as recited in claim 32, wherein said tube means has a discharge passageway length of at least one half an inch.

35. The method as recited in claim 34, wherein said passageway length is at least approximately one inch.

36. The method as recited in claim 34, wherein said passageway length is at least approximately two inches.

37. The method as recited in claim 33, wherein said tube means has a discharge passageway length of at least one half an inch.

38. The method as recited in claim 37, wherein said passageway length is at least approximately one inch.

39. The method as recited in claim 38, wherein said passageway length is at least approximately two inches.

40. The assembly as recited in claim 39, wherein said apparatus comprises an aerosol dispensing apparatus having a material containing portion containing said texture material and discharge nozzle means.

41. The assembly as recited in claim 40, wherein said texture material comprises a liquid with a particulate filler material therein, and there is within said material containing section a propellant to cause said texture material to be dispensed under pressure.

42. The assembly as recited in claim 41, wherein said propellant is a hydrocarbon gas, which, when in said containing portion, is liquefied and dispensed in said texture material.

43. An assembly for applying a hardenable liquid texture material onto a surface area to form a textured surface, said assembly comprising:

a. a texture material dispensing apparatus which has a discharge nozzle means and which is adapted to discharge said liquid material under pressure from said nozzle means;

b. a dispensing tubes means defining an elongate dispensing passageway having an inlet and an outlet, and the inlet of said dispensing tube means being adjacent to said discharge nozzle means so that the liquid texture material from the discharge nozzle means flows into the inlet of said tube means and through said dispensing passageway;

c. the assembly being characterized in that with said dispensing tube means on the apparatus being spaced from said surface area so that the outlet of the dispensing tube means is directed toward said surface area and spaced therefrom, and with the apparatus being operated so that said liquid texture material is delivered by said apparatus under pressure from said nozzle means and into said dispensing tube passageway to be discharged from the outlet of the tube means as a spray, said texture material is deposited on said surface area spray pattern to harden to form said textured surface.

44. The assembly as recited in claim 43, wherein said liquid texture material comprises a solvent, a particulate filler material and a propellant.

45. The assembly as recited in claim 44, wherein said liquid texture material further comprises a resin component.

46. The assembly as recited in claim 43, wherein propellant is a hydrocarbon gas disbursed in said texture material in a liquefied form.

47. The assembly as recited in claim 41, said dispensing tube means is detachably mounted to said discharging nozzle means.

48. The assembly as recited in claim 47, wherein said containing portion has a lower end and an upper end, and said nozzle means is positioned at the upper end of the containing portion, said nozzle means having a laterally extending nozzle opening, said dispensing nozzle means being arranged to be manually operable to cause the texture material to be discharged, said tube means being mounted to said nozzle means in a manner to be extending laterally therefrom.

49. The assembly as recited in claim 43, wherein said passageway has a cross-sectional area equivalent to a cross-sectional circular area of a given diameter, with said given diameter being at least about one quarter of a tenth of an inch, and no greater than one quarter of an inch.

50. The assembly as recited in claim 49, wherein said given diameter is at least as great as about one half of a tenth of an inch, and no greater than about one and one half tenth of an inch.

51. The assembly as recited in claim 43, wherein said tube means has a discharge passageway length of at least one half an inch.

52. The assembly as recited in claim 51, wherein said passageway length is at least approximately one inch.

53. The assembly as recited in claim 52, wherein said passageway length is at least approximately two inches.

* * * * *

UNITED STATES PATENT AND TRADEMARK OFFICE

CERTIFICATE OF CORRECTION

PATENT NO. : 5,409,148

DATED : April 25, 1995

INVENTOR(S) : Stern et al.

It is certified that error appears in the above—identified patent and that said Letters Patent is hereby corrected as shown below:

Column 11, line 12, "tubes" should read --tube--.

Signed and Sealed this

Eleventh Day of July, 1995

Bruce Lehman

*Attest:*

BRUCE LEHMAN

*Attesting Officer*

*Commissioner of Patents and Trademarks*